US010856082B1

(12) United States Patent
Chen

(10) Patent No.: US 10,856,082 B1
(45) Date of Patent: Dec. 1, 2020

(54) AUDIO SYSTEM WITH SOUND-FIELD-TYPE NATURE SOUND EFFECT

(71) Applicant: ECHOWELL ELECTRONIC CO., LTD., New Taipei (TW)

(72) Inventor: Hsi-Hsien Chen, New Taipei (TW)

(73) Assignee: ECHOWELL ELECTRONIC CO., LTD., New Taipei (TW)

( * ) Notice: Subject to any disclaimer, the term of this patent is extended or adjusted under 35 U.S.C. 154(b) by 0 days.

(21) Appl. No.: 16/596,915

(22) Filed: Oct. 9, 2019

(51) Int. Cl.
*H04R 5/04* (2006.01)
*H04S 7/00* (2006.01)

(52) U.S. Cl.
CPC ..... *H04R 5/04* (2013.01); *H04S 7/305* (2013.01)

(58) Field of Classification Search
None
See application file for complete search history.

(56) References Cited

U.S. PATENT DOCUMENTS 4,921,559 A * 5/1990 Odajima ..... H04R 7/02 156/242
5,870,484 A * 2/1999 Greenberger ..... H04R 5/02 381/17
5,999,630 A * 12/1999 Iwamatsu ..... H04S 1/002 381/17
6,498,856 B1 * 12/2002 Itabashi ..... H04R 5/02 381/302
2005/0129258 A1 * 6/2005 Fincham ..... H04S 3/002 381/160
2019/0058954 A1 * 2/2019 Bellas ..... H04R 1/2888

* cited by examiner

*Primary Examiner* — Paul W Huber
(74) *Attorney, Agent, or Firm* — Locke Lord LLP; Tim Tingkang Xia, Esq.

(57) ABSTRACT

An audio system with sound-field-type nature sound effect includes: a first primary channel playing device for playing a primary audio signal generated according to a left channel audio signal and/or a right channel audio signal; a first secondary signal circuit for generating a first secondary audio signal according to the left channel audio signal and the right channel audio signal; and a first sound field control playing device connected to the first secondary signal circuit and adapted to play the first secondary audio signal; wherein a first playing delay period exists between the playing of the first secondary audio signal and the playing of the primary audio signal; wherein the first secondary audio signal played by the first sound field control playing device does not undergo audio mixing with the primary audio signal by a first audio mixing circuit.

15 Claims, 11 Drawing Sheets

AUDIO SYSTEM WITH SOUND-FIELD-TYPE NATURE SOUND EFFECT

BACKGROUND OF THE INVENTION

Field of the Invention

The present disclosure relates to audio systems with sound-field-type nature sound effect and, more particularly, to an audio system which comprises a secondary signal circuit and a sound field control playing device and has a sound-field-type nature sound effect.

Description of the Prior Art

A conventional audio system attains surround sound by head-related transfer function (HRTF) computation, wherein a computed secondary audio signal is audio-mixed with a primary audio signal by an audio mixer. As a result, the audio signal output by an electronic audio mixing system is unnatural, causing a user to perceive clearly that the audio signal was processed artificially and thus is unnatural. In view of this, for the reduction of the unnaturalness of the output audio signal, an audio system with sound-field-type nature sound effect in which the audio is mixed in a natural environment rather than mixed by an electronic audio mixer will be required.

SUMMARY OF THE INVENTION

In view of the aforesaid drawbacks of the prior art, it is an objective of the present disclosure to provide an audio system with sound-field-type nature sound effect in which the audio is mixed in a natural environment rather than mixed by an electronic audio mixer.

In order to achieve the above and other objectives, the present disclosure provides an audio system with sound-field-type nature sound effect, comprising: a first primary channel playing device for playing a primary audio signal generated according to a left channel audio signal and/or a right channel audio signal; a first secondary signal circuit for generating a first secondary audio signal according to the left channel audio signal and the right channel audio signal; and a first sound field control playing device connected to the first secondary signal circuit and adapted to play the first secondary audio signal; wherein a first playing delay period exists between the playing of the first secondary audio signal and the playing of the primary audio signal; wherein the first secondary audio signal played by the first sound field control playing device does not undergo audio mixing with the primary audio signal by a first audio mixing circuit.

In a preferred embodiment of the present disclosure, the primary audio signal is obtained as a result of audio mixing of the left channel audio signal and the right channel audio signal by a primary channel audio mixer.

In a preferred embodiment of the present disclosure, the primary audio signal played by the first primary channel playing device and the first secondary audio signal played by the first sound field control playing device undergo audio mixing in a natural environment after being played.

In a preferred embodiment of the present disclosure, the first primary channel playing device faces a first playing direction, the first sound field control playing device faces a second playing direction, and an angle between the first playing direction and the second playing direction is greater than 45 degrees.

In a preferred embodiment of the present disclosure, the first secondary signal circuit comprises: a first subtracting operational amplifier; a first attenuator connected to the first subtracting operational amplifier from behind; a first high-pass filter connected to the first attenuator from behind; a first digit delay circuit connected to the first high-pass filter from behind; and a first amplifier connected to the first digit delay circuit from behind.

In a preferred embodiment of the present disclosure, the first sound field control playing device has a low-pass filtering function.

In a preferred embodiment of the present disclosure, the first sound field control playing device has a first wool felt dustproof portion and a first kraft voice coil, and the first sound field control playing device achieves the low-pass filtering function by the first wool felt dustproof portion and the first kraft voice coil.

In a preferred embodiment of the present disclosure, a length of the first playing delay period is determined according to a control signal provided by a user.

In a preferred embodiment of the present disclosure, the audio system with sound-field-type nature sound effect further comprises: a second primary channel playing device for playing the right channel audio signal; a second secondary signal circuit for generating a second secondary audio signal according to the left channel audio signal and the right channel audio signal; and a second sound field control playing device connected to the second secondary signal circuit and adapted to play the second secondary audio signal; wherein the primary audio signal is the left channel audio signal; wherein a second playing delay period exists between the playing of the second secondary audio signal and the playing of the right channel audio signal; wherein the second secondary audio signal played by the second sound field control playing device does not undergo audio mixing with the primary audio signal and/or the right channel audio signal by a second audio mixing circuit.

In a preferred embodiment of the present disclosure, the right channel audio signal played by the second primary channel playing device and the second secondary audio signal played by the second sound field control playing device undergo audio mixing in a natural environment after being played.

In a preferred embodiment of the present disclosure, the second primary channel playing device faces a third playing direction, the second sound field control playing device faces a fourth playing direction, and an angle between the third playing direction and the fourth playing direction is greater than 45 degrees.

In a preferred embodiment of the present disclosure, the second secondary signal circuit comprises: a second subtracting operational amplifier; a second attenuator connected to the second subtracting operational amplifier from behind; a second high-pass filter connected to the second attenuator from behind; a second digit delay circuit connected to the second high-pass filter from behind; and a second amplifier connected to the second digit delay circuit from behind.

In a preferred embodiment of the present disclosure, the second secondary signal circuit comprises: an adding operational amplifier; a second attenuator connected to the second subtracting operational amplifier from behind; a second high-pass filter connected to the second attenuator from behind; a second digit delay circuit connected to the second high-pass filter from behind; and a second amplifier connected to the second digit delay circuit from behind.

In a preferred embodiment of the present disclosure, the second sound field control playing device has a low-pass filtering function.

In a preferred embodiment of the present disclosure, the second sound field control playing device has a second wool felt dustproof portion and a second kraft voice coil, the second sound field control playing device achieves the low-pass filtering function by the second wool felt dustproof portion and the second kraft voice coil.

In a preferred embodiment of the present disclosure, a length of the second playing delay period is determined according to a control signal provided by a user.

All the aforesaid aspects and the other aspects of the present disclosure are illustrated by non-restrictive specific embodiments below, and depicted by the accompanying drawings.

DETAILED DESCRIPTION OF THE EMBODIMENTS

Figure 1:
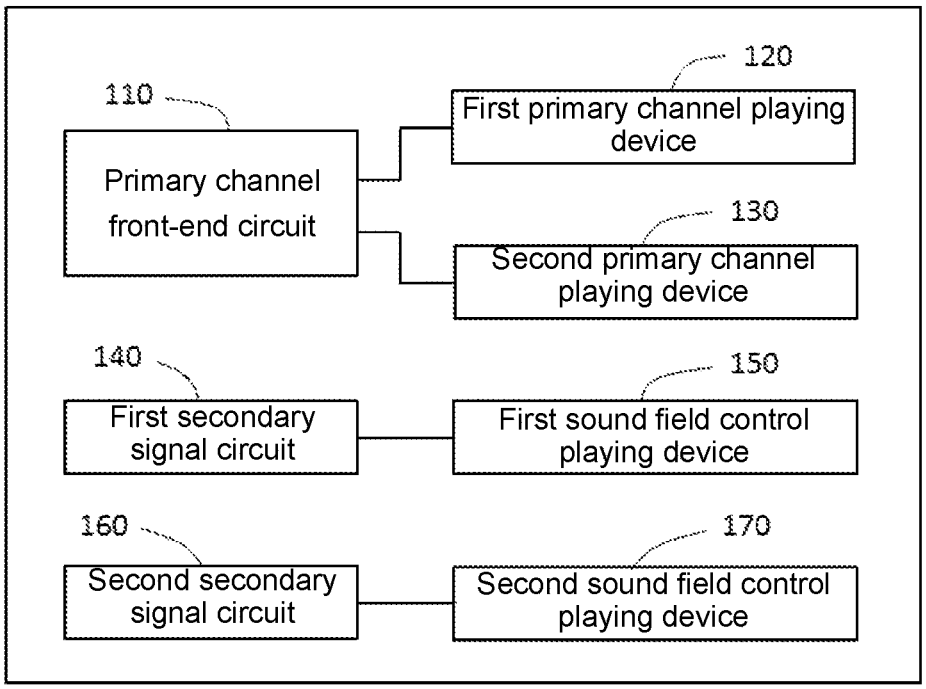
FIG. 1 is a block diagram of an audio system with sound-field-type nature sound effect according to a specific embodiment of the present disclosure.

Referring to FIG. 1, there is shown a block diagram of an audio system with sound-field-type nature sound effect according to a specific embodiment of the present disclosure. In the embodiment illustrated by FIG. 1, an audio system 100 with sound-field-type nature sound effect comprises a primary channel front-end circuit 110, first primary channel playing device 120, second primary channel playing device 130, first secondary signal circuit 140, first sound field control playing device 150, second secondary signal circuit 160 and second sound field control playing device 170. The primary channel front-end circuit 110 is connected to the first primary channel playing device 120 and second primary channel playing device 130. The first secondary signal circuit 140 is connected to the first sound field control playing device 150. The second secondary signal circuit 160 is connected to the second sound field control playing device 170.

In the embodiment illustrated by FIG. 1, the first primary channel playing device 120 plays a left channel audio signal provided by the primary channel front-end circuit 110. The second primary channel playing device 130 plays a right channel audio signal provided by the primary channel front-end circuit 110. In a specific embodiment, the left channel audio signal and the right channel audio signal are received by the primary channel front-end circuit 110. The first secondary signal circuit 140 generates a first secondary audio signal according to the left channel audio signal and the right channel audio signal, and the first sound field control playing device 150 plays the first secondary audio signal. The second secondary signal circuit 160 generates a second secondary audio signal according to the left channel audio signal and the right channel audio signal, and the second sound field control playing device 170 plays the second secondary audio signal. A first playing delay period exists between the playing of the first secondary audio signal and the playing of the left channel audio signal. A second playing delay period exists between the playing of the second secondary audio signal and the playing of the right channel audio signal. Hence, the first sound field control playing device 150 does not play the first secondary audio signal until the first playing delay period after the first primary channel playing device 120 has played the left channel audio signal. The second sound field control playing device 170 does not play the second secondary audio signal until the second playing delay period after the second primary channel playing device 130 has played the right channel audio signal. In a specific embodiment, the length of the first playing delay period and the length of the second playing delay period are determined according to a control signal provided by the user. In a specific embodiment, the length of the first playing delay period and the length of the second playing delay period are determined according to the user's preference, size of audition environment or factory default settings. In a specific embodiment, the user controls the length of the first playing delay period and the length of the second playing delay period with a first control signal and a second control signal, respectively. In a specific embodiment, the length of the first playing delay period and the length of the second playing delay period range from 10 ms to 300 ms. In a specific embodiment, the audio system 100 with sound-field-type nature sound effect is a stereo system. The longer the playing delay periods are, the larger the audition environment is, resulting in higher sound field performance.

In the embodiment illustrated by FIG. 1, the first secondary audio signal played by the first sound field control playing device 150 does not undergo the audio mixing with the left channel audio signal and/or the right channel audio signal by any audio mixing circuit or audio mixer, whereas the second secondary audio signal played by the second sound field control playing device 170 does not undergo the audio mixing with the left channel audio signal and/or the right channel audio signal by any audio mixing circuit or audio mixer. It is understandable that the left channel audio signal played by the first primary channel playing device 120 and the first secondary audio signal played by the first sound field control playing device 150 undergo the audio mixing in a natural environment after being played, whereas the right channel audio signal played by the second primary channel playing device 130 and the second secondary audio signal played by the second sound field control playing device 170 undergo the audio mixing in a natural environment after being played.

Figure 2:
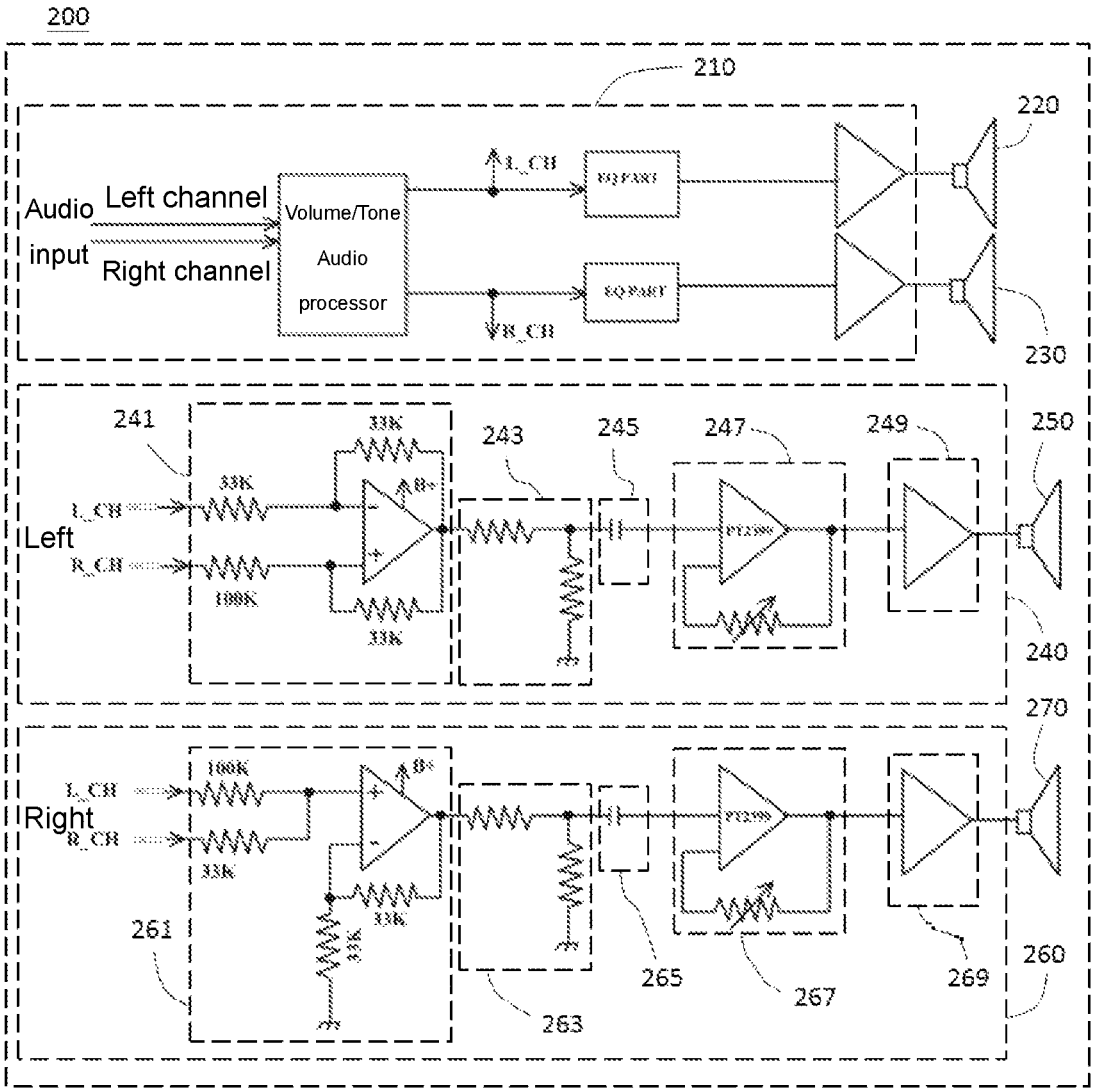
FIG. 2 is a schematic view of an audio system with sound-field-type nature sound effect according to a specific embodiment of the present disclosure.

Referring to FIG. 2, there is shown a schematic view of an audio system with sound-field-type nature sound effect according to a specific embodiment of the present disclosure. In the embodiment illustrated by FIG. 2, an audio system 200 with sound-field-type nature sound effect is a stereo system. The audio system 200 with sound-field-type nature sound effect comprises a primary channel front-end circuit 210, first primary channel playing device 220, second primary channel playing device 230, first secondary signal circuit 240, first sound field control playing device 250, second secondary signal circuit 260 and second sound field control playing device 270. The primary channel front-end circuit 210 is connected to the first primary channel playing device 220 and second primary channel playing device 230. The first secondary signal circuit 240 is connected to the first sound field control playing device 250. The second secondary signal circuit 260 is connected to the second sound field control playing device 270.

In the embodiment illustrated by FIG. 2, the first secondary signal circuit 240 comprises a first subtracting operational amplifier 241, first attenuator 243, first high-pass filter 245, first digit delay circuit 247 and first amplifier 249. The first attenuator 243 is connected to the first subtracting operational amplifier 241 from behind. The first high-pass filter 245 is connected to the first attenuator 243 from behind. The first digit delay circuit 247 is connected to the first high-pass filter 245 from behind. The first amplifier 249 is connected to the first digit delay circuit 247 from behind. The first amplifier 249 is connected to the first sound field control playing device 250. The second secondary signal circuit 260 comprises an adding operational amplifier 261, second attenuator 263, second high-pass filter 265, second digit delay circuit 267 and second amplifier 269. The second attenuator 263 is connected to the adding operational amplifier 261 from behind. The second high-pass filter 265 is connected to the second attenuator 263 from behind. The second digit delay circuit 267 is connected to the second high-pass filter 265 from behind. The second amplifier 269 is connected to the second digit delay circuit 267 from behind. The second amplifier 269 is connected to the second sound field control playing device 270. In a specific embodiment, the first sound field control playing device 250 has a low-pass filtering function, and thus no low-pass filter needs to be disposed between the first amplifier 249 and first sound field control playing device 250. In a specific embodiment, the second sound field control playing device 270 has a low-pass filtering function, and thus no low-pass filter needs to be disposed between the second amplifier 269 and second sound field control playing device 270.

In a specific embodiment, the first secondary audio signal is expressed as:

$$\frac{1}{n}*\left(L-\frac{1}{n}*R\right)$$

and the second secondary audio signal is expressed as:

$$\frac{1}{n}*\left(R+\frac{1}{n}*L\right)$$

where the left channel audio signal is denoted by L, the right channel audio signal by R, and magnification factor by n. In a variant specific embodiment, n is predetermined as needed or adjusted by the user as needed. In a variant specific embodiment, n is a fixed value or is set in a remotely-controlled manner.

Figure 3:
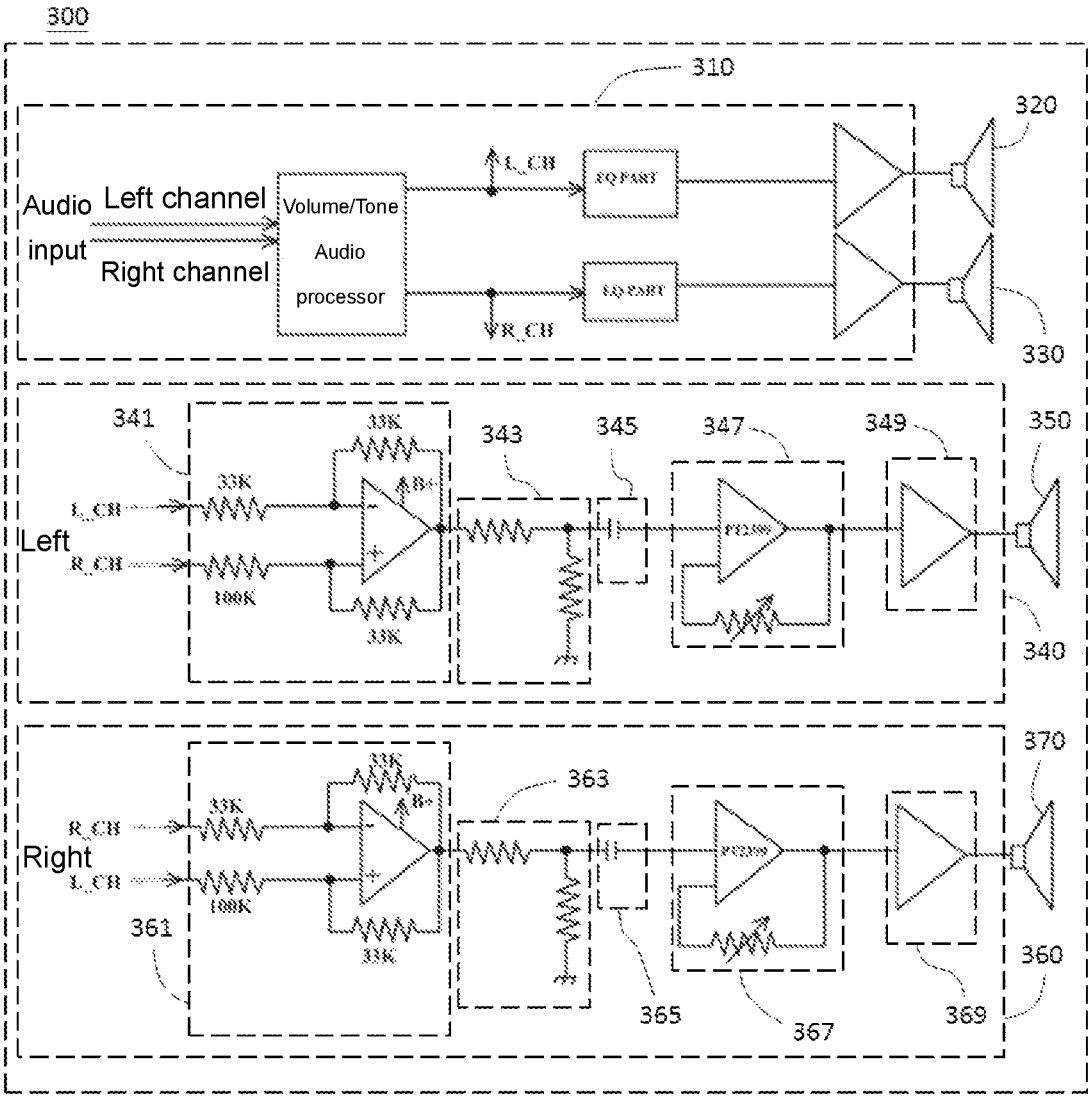
FIG. 3 is a schematic view of an audio system with sound-field-type nature sound effect according to a specific embodiment of the present disclosure.

Referring to FIG. 3, there is shown a schematic view of an audio system with sound-field-type nature sound effect according to a specific embodiment of the present disclosure. In the embodiment illustrated by FIG. 3, an audio system 300 with sound-field-type nature sound effect is a stereo system. The audio system 300 with sound-field-type nature sound effect comprises a primary channel front-end circuit 310, first primary channel playing device 320, second primary channel playing device 330, first secondary signal circuit 340, first sound field control playing device 350, second secondary signal circuit 360 and second sound field control playing device 370. The primary channel front-end circuit 310 is connected to the first primary channel playing device 320 and second primary channel playing device 330. The first secondary signal circuit 340 is connected to the first sound field control playing device 350. The second secondary signal circuit 360 is connected to the second sound field control playing device 370.

In the embodiment illustrated by FIG. 3, the first secondary signal circuit 340 comprises a first subtracting operational amplifier 341, first attenuator 343, first high-pass filter 345, first digit delay circuit 347 and first amplifier 349. The first attenuator 343 is connected to the first subtracting operational amplifier 341 from behind. The first high-pass filter 345 is connected to the first attenuator 343 from behind. The first digit delay circuit 347 is connected to the first high-pass filter 345 from behind. The first amplifier 349 is connected to the first digit delay circuit 347 from behind. The first amplifier 349 is connected to the first sound field control playing device 350. The second secondary signal circuit 360 comprises a second subtracting operational amplifier 361, second attenuator 363, second high-pass filter 365, second digit delay circuit 367 and second amplifier 369. The second attenuator 363 is connected to the second subtracting operational amplifier 361 from behind. The second high-pass filter 365 is connected to the second attenuator 363 from behind. The second digit delay circuit 367 is connected to the second high-pass filter 365 from behind. The second amplifier 369 is connected to the second digit delay circuit 367 from behind. The second amplifier 369 is connected to the second sound field control playing device 370. In a specific embodiment, the first sound field control playing device 350 is capable of low-pass filtering, and thus no low-pass filter needs to be disposed between the first amplifier 349 and first sound field control playing device 350. In a specific embodiment, the second sound field control playing device 370 is capable of low-pass filtering, and thus no low-pass filter needs to be disposed between the second amplifier 369 and second sound field control playing device 370.

In a specific embodiment, the first secondary audio signal is expressed as:

$$\frac{1}{n}*\left(-L-\frac{1}{n}*R\right)$$

and the second secondary audio signal is expressed as:

$$\frac{1}{n}*\left(-R-\frac{1}{n}*L\right)$$

where the left channel audio signal is denoted by L, the right channel audio signal by R, and magnification factor by n. In a variant specific embodiment, n is predetermined as needed or adjusted by the user as needed. In a variant specific embodiment, n is a fixed value or is set in a remotely-controlled manner.

Figure 4:
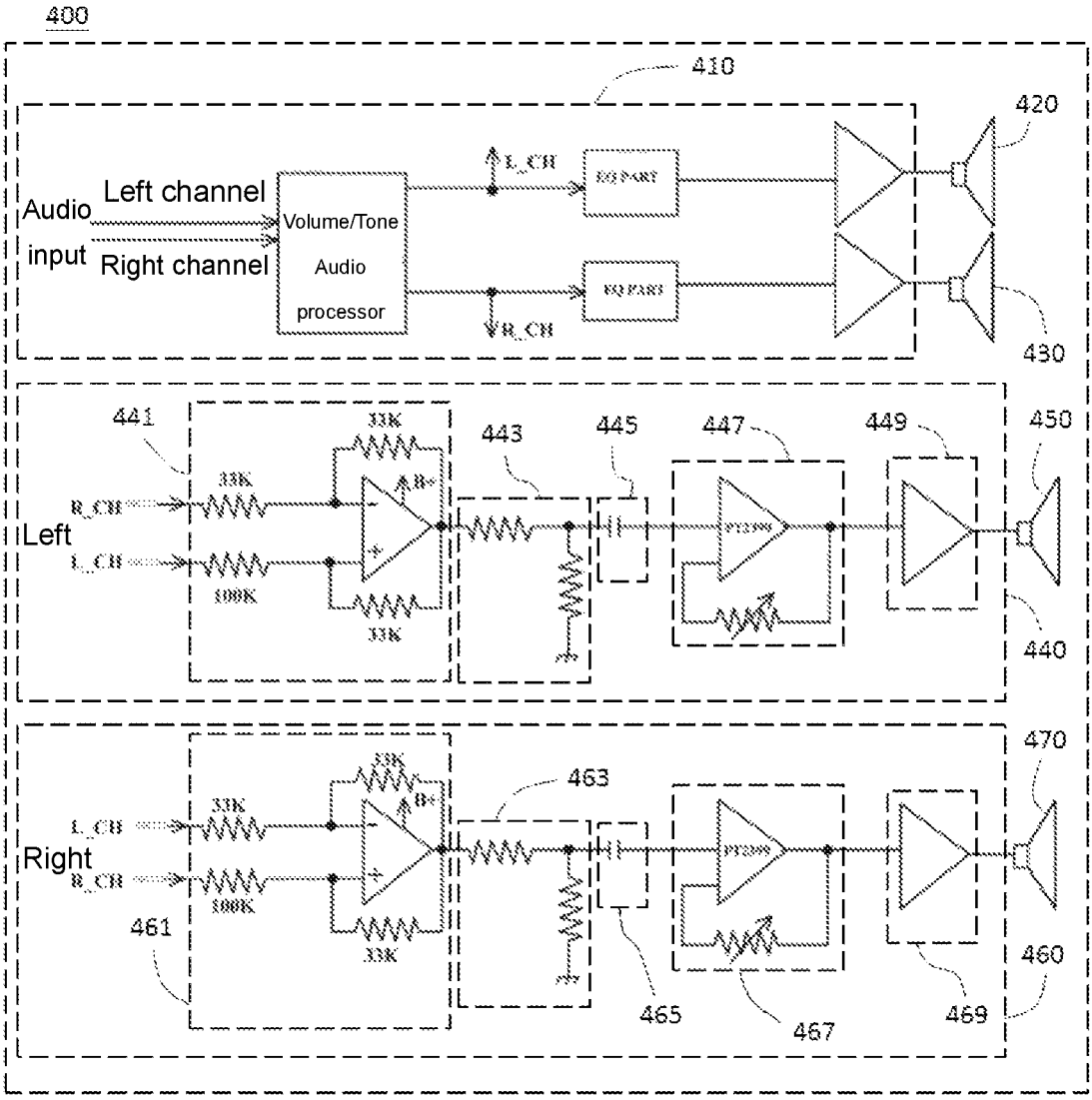
FIG. 4 is a schematic view of an audio system with sound-field-type nature sound effect according to a specific embodiment of the present disclosure.

Referring to FIG. 4, there is shown a schematic view of an audio system with sound-field-type nature sound effect according to a specific embodiment of the present disclosure. In the embodiment illustrated by FIG. 4, an audio system 400 with sound-field-type nature sound effect is a stereo system. The audio system 400 with sound-field-type nature sound effect comprises a primary channel front-end circuit 410, first primary channel playing device 420, second primary channel playing device 430, first secondary signal circuit 440, first sound field control playing device 450, second secondary signal circuit 460 and second sound field control playing device 470. The primary channel front-end circuit 410 is connected to the first primary channel playing device 420 and second primary channel playing device 430. The first secondary signal circuit 440 is connected to the first sound field control playing device 450. The second secondary signal circuit 460 is connected to the second sound field control playing device 470.

In the embodiment illustrated by FIG. 4, the first secondary signal circuit 440 comprises a first subtracting operational amplifier 441, first attenuator 443, first high-pass filter 445, first digit delay circuit 447 and first amplifier 449. The first attenuator 443 is connected to the first subtracting operational amplifier 441 from behind. The first high-pass filter 445 is connected to the first attenuator 443 from behind. The first digit delay circuit 447 is connected to the first high-pass filter 445 from behind. The first amplifier 449 is connected to the first digit delay circuit 447 from behind. The first amplifier 449 is connected to the first sound field control playing device 450. The second secondary signal circuit 460 comprises a second subtracting operational amplifier 461, second attenuator 463, second high-pass filter 465, second digit delay circuit 467 and second amplifier 469. The second attenuator 463 is connected to the second subtracting operational amplifier 461 from behind. The second high-pass filter 465 is connected to the second attenuator 463 from behind. The second digit delay circuit 467 is connected to the second high-pass filter 465 from behind. The second amplifier 469 is connected to the second digit delay circuit 467 from behind. The second amplifier 469 is connected to the second sound field control playing device 470. In a specific embodiment, the first sound field control playing device 450 is capable of low-pass filtering, and thus no low-pass filter needs to be disposed between the first amplifier 449 and first sound field control playing device 450. In a specific embodiment, the second sound field control playing device 470 is capable of low-pass filtering, and thus no low-pass filter needs to be disposed between the second amplifier 469 and second sound field control playing device 470.

In a specific embodiment, the first secondary audio signal is expressed as:

$$\frac{1}{n}*\left(-R-\frac{1}{n}*L\right)$$

and the second secondary audio signal is expressed as:

$$\frac{1}{n}*\left(-L-\frac{1}{n}*R\right)$$

where the left channel audio signal is denoted by L, the right channel audio signal by R, and magnification factor by n. In a variant specific embodiment, n is predetermined as needed or adjusted by the user as needed. In a variant specific embodiment, n is a fixed value or is set in a remotely-controlled manner.

Figure 5:
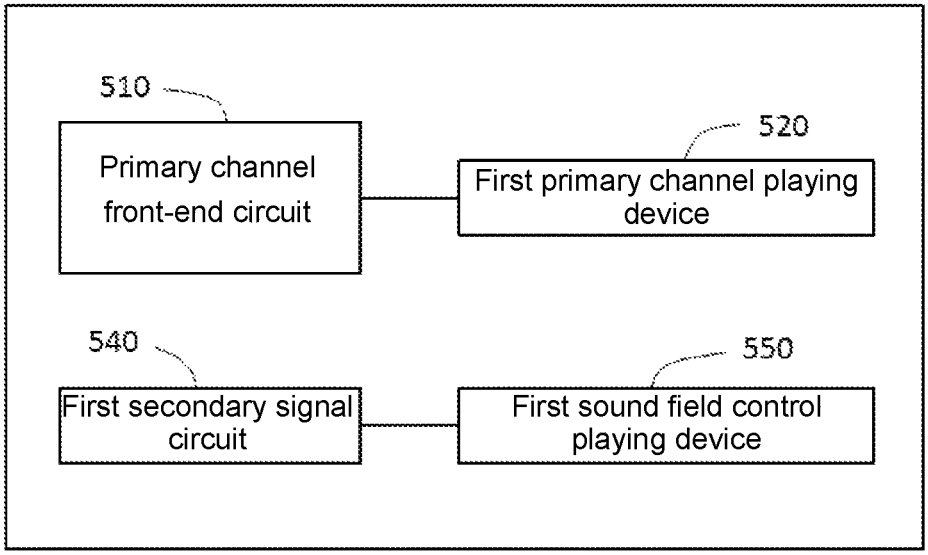
FIG. 5 is a block diagram of an audio system with sound-field-type nature sound effect according to a specific embodiment of the present disclosure.

Referring to FIG. 5, there is shown a block diagram of an audio system with sound-field-type nature sound effect according to a specific embodiment of the present disclosure. In the embodiment illustrated by FIG. 5, an audio system 500 with sound-field-type nature sound effect is a mono system and comprises a primary channel front-end circuit 510, first primary channel playing device 520, first secondary signal circuit 540 and first sound field control playing device 550. The primary channel front-end circuit 510 is connected to the first primary channel playing device 520. The first secondary signal circuit 540 is connected to the first sound field control playing device 550.

In the embodiment illustrated by FIG. 5, the first primary channel playing device 520 plays a primary audio signal provided by the primary channel front-end circuit 510. The primary audio signal is generated according to the audio mixing of the left channel audio signal and/or the right channel audio signal. In a specific embodiment, the left channel audio signal and the right channel audio signal are received by the primary channel front-end circuit 510. In a specific embodiment, the primary audio signal is obtained as a result of the audio mixing of the left channel audio signal and the right channel audio signal by a primary channel audio mixer of the primary channel front-end circuit 510. The first secondary signal circuit 540 generates the first secondary audio signal according to the left channel audio signal and the right channel audio signal, and the first sound field control playing device 550 plays the first secondary audio signal. The first playing delay period exists between the playing of the first secondary audio signal and the playing of the primary audio signal. Hence, the first sound field control playing device 550 does not play the first secondary audio signal until the first playing delay period after the first primary channel playing device 520 has played the primary audio signal. In a specific embodiment, the length of the first playing delay period is determined according to a control signal provided by the user. In a specific embodiment, the length of the first playing delay period is determined according to the user's preference, size of audition environment or factory default settings. In a specific embodiment, the length of the first playing delay period ranges from 10 ms to 300 ms. In a specific embodiment, the audio system 500 with sound-field-type nature sound effect is a mono system. It should be understand that the longer the playing delay periods are, the larger the audition environment becomes, and resulting in larger sound field performance.

In the embodiment illustrated by FIG. 5, the first secondary audio signal played by the first sound field control playing device 550 does not undergo the audio mixing with the primary audio signal by any audio mixing circuit or audio mixer. It is understandable that the primary audio signal played by the first primary channel playing device 520 and the first secondary audio signal played by the first sound field control playing device 550 undergo the audio mixing in a natural environment after being played.

Figure 6:
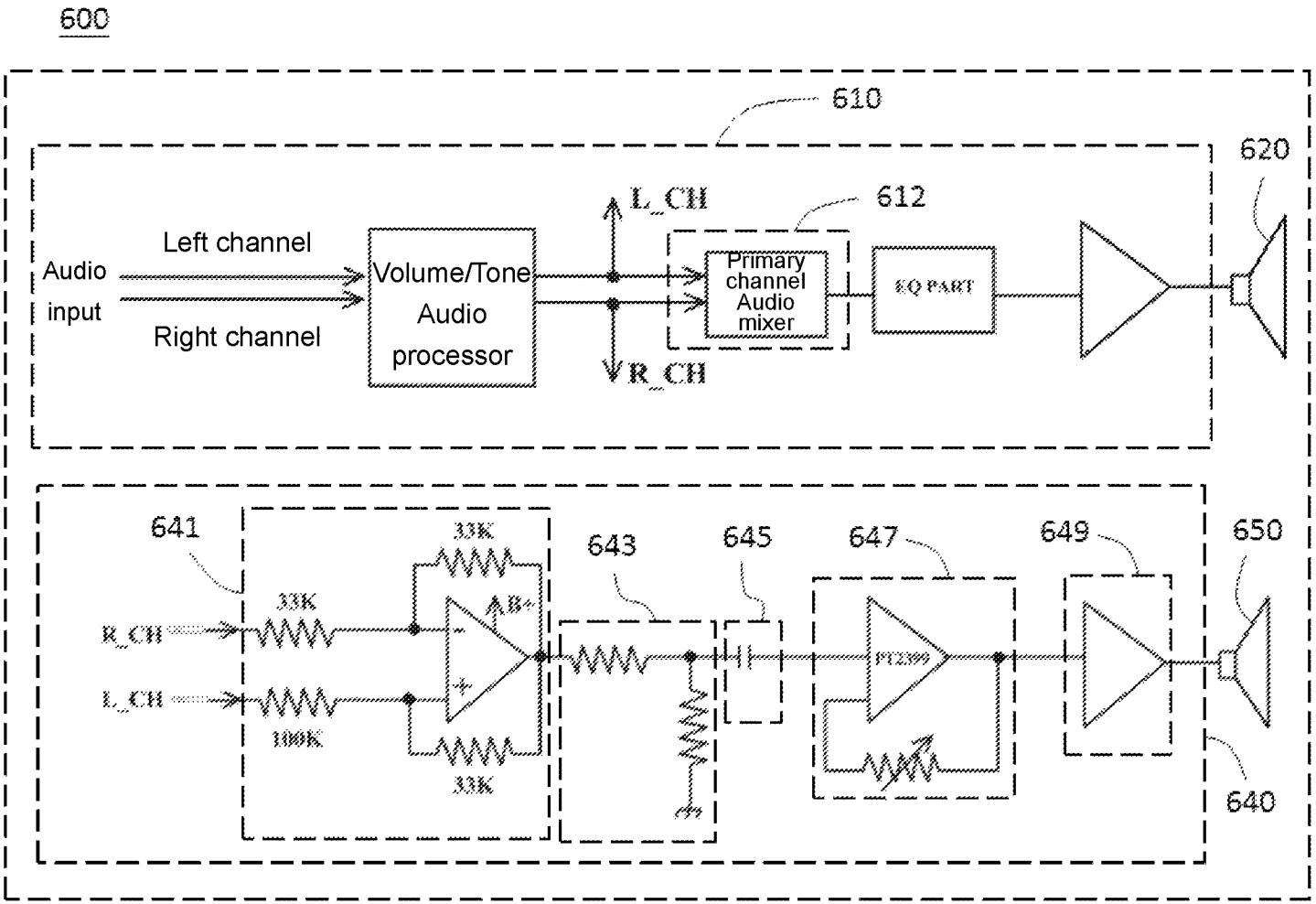
FIG. 6 is a schematic view of an audio system with sound-field-type nature sound effect according to a specific embodiment of the present disclosure.

Referring to FIG. 6, there is shown a schematic view of an audio system with sound-field-type nature sound effect according to a specific embodiment of the present disclosure. In the embodiment illustrated by FIG. 6, an audio system 600 with sound-field-type nature sound effect is a mono system. The audio system 600 with sound-field-type nature sound effect comprises a primary channel front-end circuit 610, first primary channel playing device 620, first secondary signal circuit 640 and first sound field control playing device 650. The primary channel front-end circuit 610 is connected to the first primary channel playing device 620. The first secondary signal circuit 640 is connected to the first sound field control playing device 650. The primary channel front-end circuit 610 has a primary channel audio mixer 612 for performing the audio mixing of the left channel audio signal and the right channel audio signal so as to generate the primary audio signal.

In the embodiment illustrated by FIG. 6, the first secondary signal circuit 640 comprises a first subtracting operational amplifier 641, first attenuator 643, first high-pass filter 645, first digit delay circuit 647 and first amplifier 649. The first attenuator 643 is connected to the first subtracting operational amplifier 641 from behind. The first high-pass filter 645 is connected to the first attenuator 643 from behind. The first digit delay circuit 647 is connected to the first high-pass filter 645 from behind. The first amplifier 649 is connected to the first digit delay circuit 647 from behind. The first amplifier 649 is connected to the first sound field control playing device 650. In a specific embodiment, the first sound field control playing device 650 is capable of low-pass filtering, and thus no low-pass filter needs to be disposed between the first amplifier 649 and first sound field control playing device 650.

In a specific embodiment, the first secondary audio signal is expressed as:

$$\frac{1}{n} * (R - L)$$

where the left channel audio signal is denoted by L, the right channel audio signal by R, and magnification factor by n. In a variant specific embodiment, n is predetermined as needed or adjusted by the user as needed. In a variant specific embodiment, n is a fixed value or is set in a remotely-controlled manner.

Figure 7:
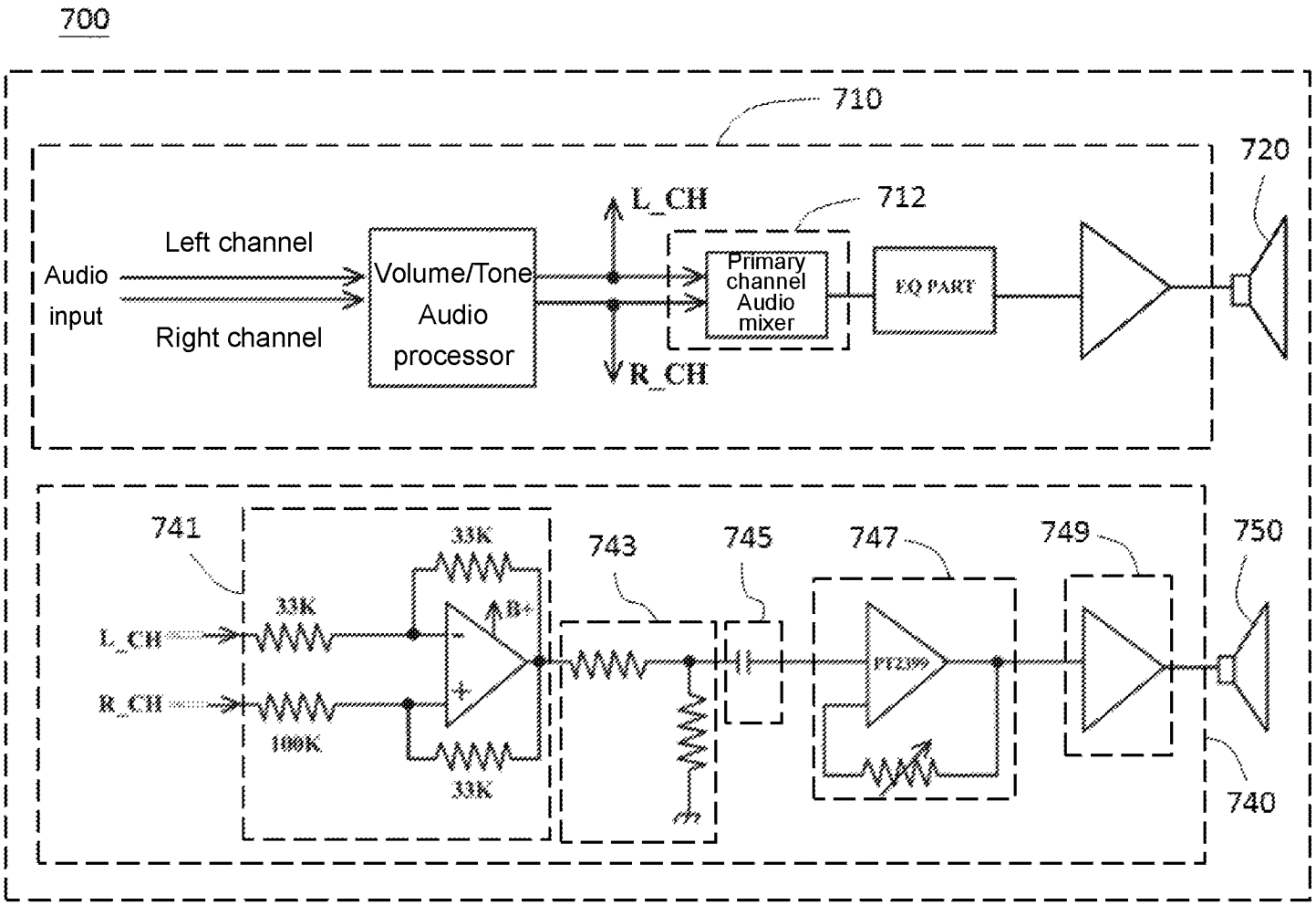
FIG. 7 is a schematic view of an audio system with sound-field-type nature sound effect according to a specific embodiment of the present disclosure.

Referring to FIG. 7, there is shown a schematic view of an audio system with sound-field-type nature sound effect according to a specific embodiment of the present disclosure. In the embodiment illustrated by FIG. 7, an audio system 700 with sound-field-type nature sound effect is a mono system. The audio system 700 with sound-field-type nature sound effect comprises a primary channel front-end circuit 710, first primary channel playing device 720, first secondary signal circuit 740 and first sound field control playing device 750. The primary channel front-end circuit 710 is connected to the first primary channel playing device 720. The first secondary signal circuit 740 is connected to the first sound field control playing device 750. The primary channel front-end circuit 710 has a primary channel audio mixer 712 for performing the audio mixing of the left channel audio signal and the right channel audio signal so as to generate the primary audio signal.

In the embodiment illustrated by FIG. 7, the first secondary signal circuit 740 comprises a first subtracting operational amplifier 741, first attenuator 743, first high-pass filter 745, first digit delay circuit 747 and first amplifier 749. The first attenuator 743 is connected to the first subtracting operational amplifier 741 from behind. The first high-pass filter 745 is connected to the first attenuator 743 from behind. The first digit delay circuit 747 is connected to the first high-pass filter 745 from behind. The first amplifier 749 is connected to the first digit delay circuit 747 from behind. The first amplifier 749 is connected to the first sound field control playing device 750. In a specific embodiment, the first sound field control playing device 750 is capable of low-pass filtering, and thus no low-pass filter needs to be disposed between the first amplifier 749 and first sound field control playing device 750.

Figure 8:
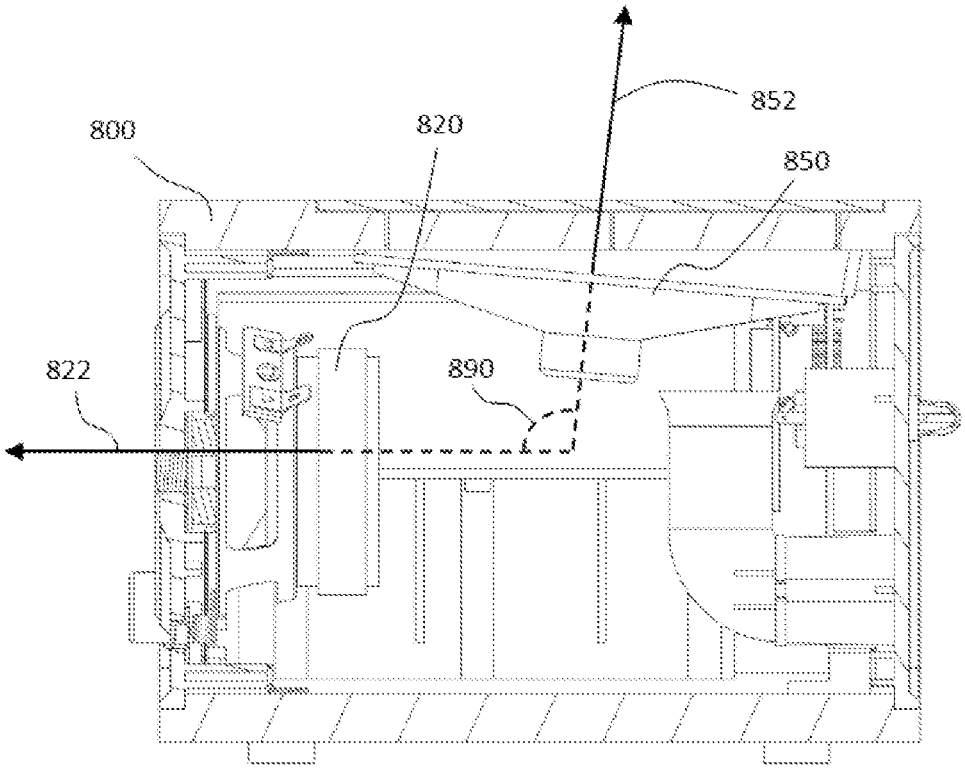
FIG. 8 is a schematic view of an audio system with sound-field-type nature sound effect according to a specific embodiment of the present disclosure.

Referring to FIG. 8, there is shown a schematic view of an audio system with sound-field-type nature sound effect according to a specific embodiment of the present disclosure. In the embodiment illustrated by FIG. 8, an audio system 800 with sound-field-type nature sound effect has a first primary channel playing device 820 facing a first playing direction 822 and a first sound field control playing device 850 facing a second playing direction 852. The angle between the first playing direction and the second playing direction ranges from 890 to 95 degrees.

Figure 9:
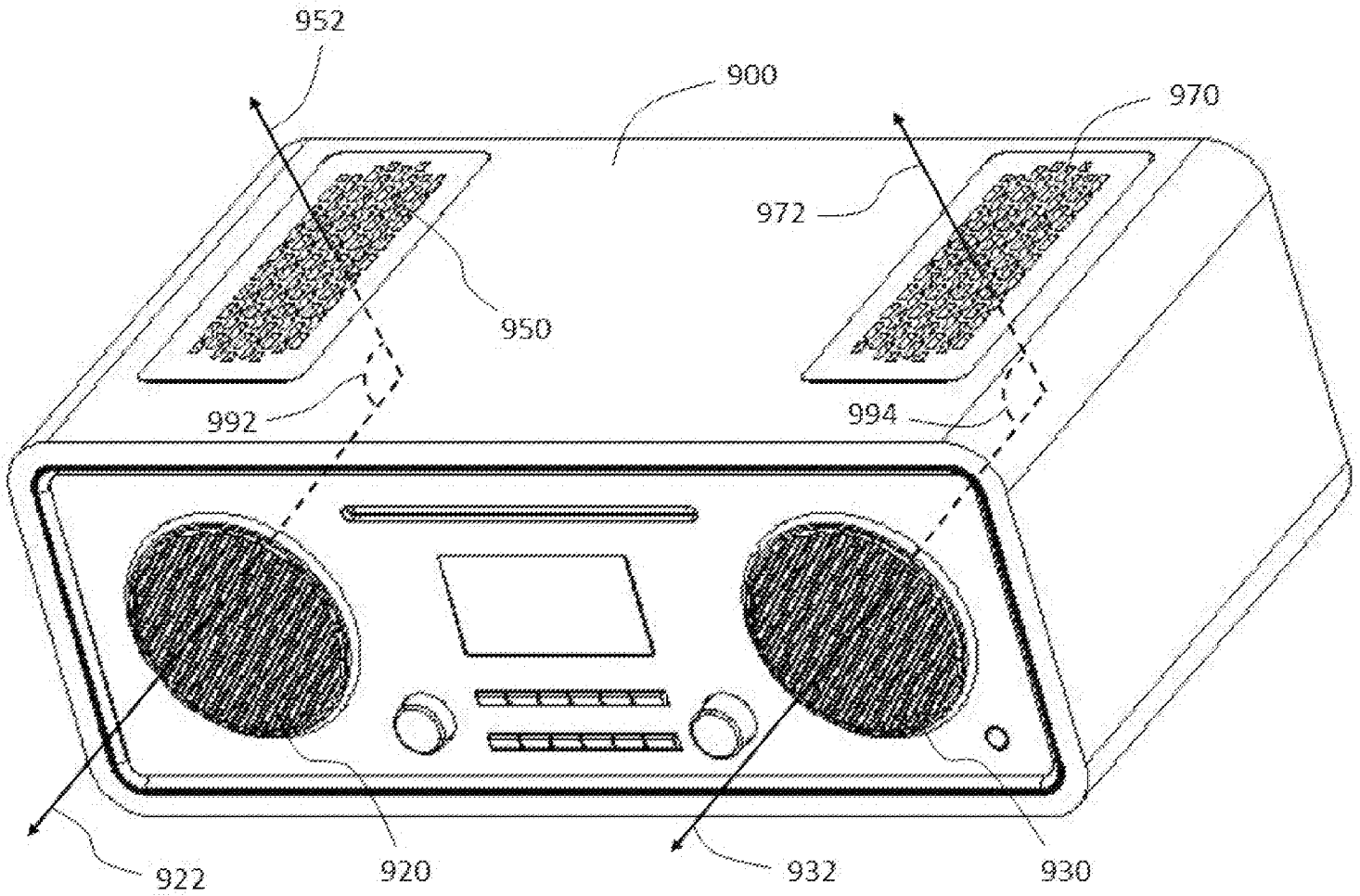
FIG. 9 is a schematic view of an audio system with sound-field-type nature sound effect according to a specific embodiment of the present disclosure.

Referring to FIG. 9, there is shown a schematic view of an audio system with sound-field-type nature sound effect according to a specific embodiment of the present disclosure. In the embodiment illustrated by FIG. 9, an audio system 900 with sound-field-type nature sound effect has a first primary channel playing device 920 facing a first playing direction 922, a first sound field control playing device 950 facing a second playing direction 952, a second primary channel playing device 930 facing a third playing direction 932, and a second sound field control playing device 970 facing a fourth playing direction 972. The angle 992 between the first playing direction 922 and the second playing direction 952 is equal to 95 degrees. The angle 994 between the third playing direction 932 and the fourth playing direction 972 is equal to 95 degrees.

It is understandable that FIG. 8 and FIG. 9 merely serve illustrative purposes. The angle between the first playing direction and the second playing direction is not only equal to 95 degrees but is also subject to changes as needed, but the angle is preferably greater than 45 degrees, and in consequence the frequency response of the first primary channel playing device is not affected by the frequency response of the first sound field control playing device. Likewise, the angle between the third playing direction and the fourth playing direction is not only equal to 95 degrees but is also subject to changes as needed, but the angle is preferably greater than 45 degrees, and in consequence the frequency response of the second primary channel playing device is not affected by the frequency response of the second sound field control playing device. It is understandable that if the angle between the first playing direction and the second playing direction is less than 45 degrees, a dustproof portion of the first sound field control playing device is made of wool felt in order to restrict horizontal directional characteristics of the first sound field control playing device and reduce its interference with the primary channel playing device.

In a specific embodiment, the sound field control playing device is produced quickly by 3D printing technology to reduce R&D costs greatly, and the sound field control playing device is provided in the form of a pelvic shell made of high-rigidity plastic, so as to not only circumvent medium- and high-frequency resonance but also enhance sound quality. In a specific embodiment, effective bandwidth of the frequency response of the sound field control playing device is restricted to 500 HZ~8KHZ-3 dB. In a specific embodiment, a voice coil of the sound field control playing device is provided in the form of a kraft voice coil, and the dustproof portion of the sound field control playing device is made of wool quilt. In a specific embodiment, the sound field control playing device is downsized, and in consequence not only does the sound field control playing device have a plastic frame or iron frame, kraft voice coil, and woollen felt cap, but its high-frequency response is also restricted.

Figure 10:
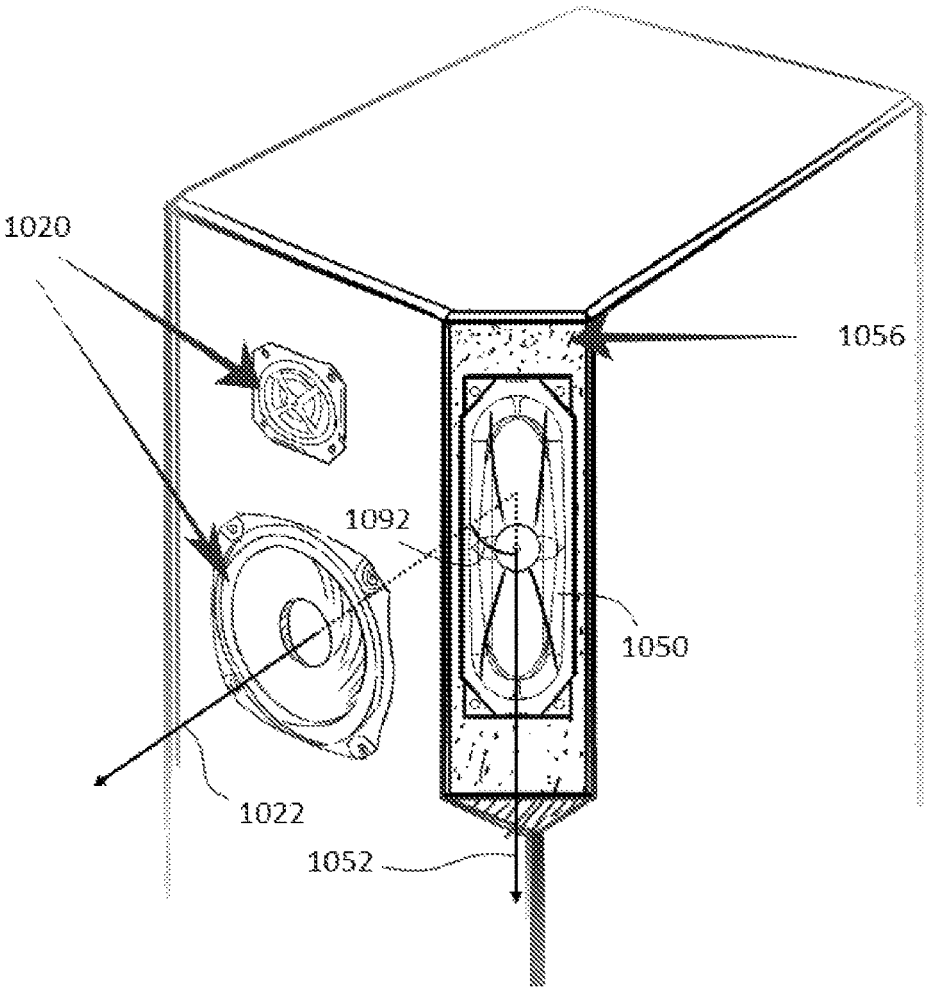
FIG. 10 is a schematic view of the audio system with sound-field-type nature sound effect according to a specific embodiment of the present disclosure.

Referring to FIG. 10, there is shown a schematic view of the audio system with sound-field-type nature sound effect according to a specific embodiment of the present disclosure. In the embodiment illustrated by FIG. 10, the angle 1092 between the first playing direction 1022 of the first primary channel playing device 1020 and the second playing direction 1052 of the first sound field control playing device 1050 is greater than 45 degrees. Furthermore, the first sound field control playing device 1050 has a wool felt dustproof portion 1056.

Figure 11:
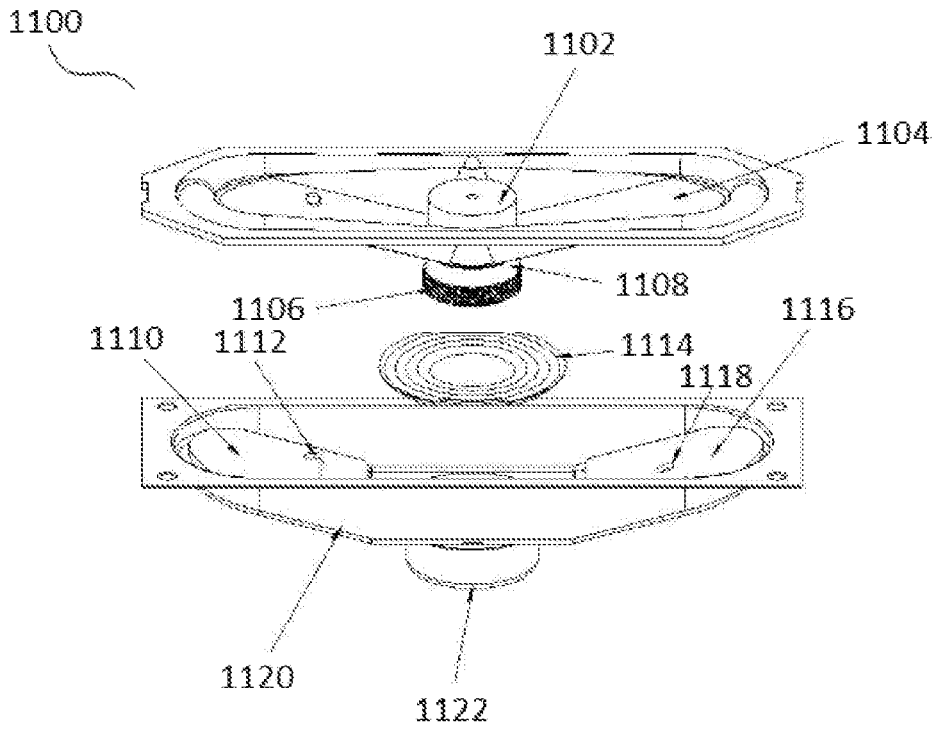
FIG. 11 is a schematic view of a sound field control playing device according to a specific embodiment of the present disclosure.

Referring to FIG. 11, there is shown a schematic view of a sound field control playing device according to a specific embodiment of the present disclosure. In the embodiment illustrated by FIG. 11, a sound field control playing device 1100 comprises a wool felt dustproof portion 1102, paper basin 1104, voice coil 1106, kraft voice coil 1108, vibration EVA 1110, speaker terminal hole 1112, damper 1114, vibration EVA 1116, anti-resonance vent 1118, pelvic shell 1120 and internal magnetic circuit 1122. The wool felt dustproof portion 1102 and kraft voice coil 1108 together form a low-pass filter, and thus the sound field control playing device 1100 is capable of low-pass filtering. In a variant specific embodiment, the pelvic shell 1120 is made of iron or plastic.

It is understandable that, according to the present disclosure, the audio system with sound-field-type nature sound effect is applied to TV-dedicated speaker systems, soundbar systems, Hi-Fi systems, and various radio systems, but the present disclosure is not limited thereto.

The audio system with sound-field-type nature sound effect according to the present disclosure is explained by the above description and drawings. However, it is understandable that every specific embodiment of the present disclosure merely serves illustrative purposes. Therefore, various changes may be made to the specific embodiments of the present disclosure without departing from the spirit and claims of the present disclosure and must be interpreted as included in the claims of the present disclosure. Therefore, the specific embodiments are not restrictive of the present disclosure. The actual scope and spirit of the present disclosure shall be defined by the appended claims.

What is claimed is:

1. An audio system with sound-field-type nature sound effect, comprising:

a first primary channel playing device for playing a primary audio signal generated according to a left channel audio signal and/or a right channel audio signal;

a first secondary signal circuit for generating a first secondary audio signal according to the left channel audio signal and the right channel audio signal; and a first sound field control playing device connected to the first secondary signal circuit and adapted to play the first secondary audio signal;

wherein a first playing delay period exists between the playing of the first secondary audio signal and the playing of the primary audio signal;

wherein the first secondary audio signal played by the first sound field control playing device does not undergo audio mixing with the primary audio signal by a first audio mixing circuit;

wherein the first secondary signal circuit comprises:

a first subtracting operational amplifier;

a first attenuator connected to the first subtracting operational amplifier from behind;

a first high-pass filter connected to the first attenuator from behind;

a first digit delay circuit connected to the first high-pass filter from behind; and a first amplifier connected to the first digit delay circuit from behind.

2. The audio system with sound-field-type nature sound effect according to claim 1, wherein the primary audio signal is obtained as a result of audio mixing of the left channel audio signal and the right channel audio signal by a primary channel audio mixer.

3. The audio system with sound-field-type nature sound effect according to claim 1, wherein the primary audio signal played by the first primary channel playing device and the first secondary audio signal played by the first sound field control playing device undergo audio mixing in a natural environment after being played.

4. The audio system with sound-field-type nature sound effect according to claim 1, wherein the first primary channel playing device faces a first playing direction, the first sound field control playing device faces a second playing direction, and an angle between the first playing direction and the second playing direction is greater than 45 degrees.

5. The audio system with sound-field-type nature sound effect according to claim 1, wherein the first sound field control playing device has a low-pass filtering function.

6. The audio system with sound-field-type nature sound effect according to claim 5, wherein the first sound field control playing device has a first wool felt dustproof portion and a first kraft voice coil, and the first sound field control playing device achieves the low-pass filtering function by the first wool felt dustproof portion and the first kraft voice coil.

7. The audio system with sound-field-type nature sound effect according to claim 1, wherein a length of the first playing delay period is determined according to a control signal provided by a user.

8. An audio system with sound-field-type nature sound effect, comprising:

a first primary channel playing device for playing a primary audio signal generated according to a left channel audio signal and/or a right channel audio signal;

a first secondary signal circuit for generating a first secondary audio signal according to the left channel audio signal and the right channel audio signal;

a first sound field control playing device connected to the first secondary signal circuit and adapted to play the first secondary audio signal;

a second primary channel playing device for playing the right channel audio signal;

a second secondary signal circuit for generating a second secondary audio signal according to the left channel audio signal and the right channel audio signal; and a second sound field control playing device connected to the second secondary signal circuit and adapted to play the second secondary audio signal;

wherein a first playing delay period exists between the playing of the first secondary audio signal and the playing of the primary audio signal;

wherein the first secondary audio signal played by the first sound field control playing device does not undergo audio mixing with the primary audio signal by a first audio mixing circuit;

wherein the primary audio signal is the left channel audio signal;

wherein a second playing delay period exists between the playing of the second secondary audio signal and the playing of the right channel audio signal;

wherein the second secondary audio signal played by the second sound field control playing device does not undergo audio mixing with the primary audio signal and/or the right channel audio signal by a second audio mixing circuit.

9. The audio system with sound-field-type nature sound effect according to claim 8, wherein the right channel audio signal played by the second primary channel playing device and the second secondary audio signal played by the second sound field control playing device undergo audio mixing in a natural environment after being played.

10. The audio system with sound-field-type nature sound effect according to claim 8, wherein the second primary channel playing device faces a third playing direction, the second sound field control playing device faces a fourth playing direction, and an angle between the third playing direction and the fourth playing direction is greater than 45 degrees.

11. The audio system with sound-field-type nature sound effect according to claim 8, wherein the second secondary signal circuit comprises:

a second subtracting operational amplifier;

a second attenuator connected to the second subtracting operational amplifier from behind;

a second high-pass filter connected to the second attenuator from behind;

a second digit delay circuit connected to the second high-pass filter from behind; and a second amplifier connected to the second digit delay circuit from behind.

12. The audio system with sound-field-type nature sound effect according to claim 8, wherein the second secondary signal circuit comprises:

an adding operational amplifier;

a second attenuator connected to the second subtracting operational amplifier from behind;

a second high-pass filter connected to the second attenuator from behind;

a second digit delay circuit connected to the second high-pass filter from behind; and a second amplifier connected to the second digit delay circuit from behind.

13. The audio system with sound-field-type nature sound effect according to claim 8, wherein the second sound field control playing device has a low-pass filtering function.

14. The audio system with sound-field-type nature sound effect according to claim 13, wherein the second sound field control playing device has a second wool felt dustproof portion and a second kraft voice coil, the second sound field control playing device achieves the low-pass filtering function by the second wool felt dustproof portion and the second kraft voice coil.

15. The audio system with sound-field-type nature sound effect according to claim 8, wherein a length of the second playing delay period is determined according to a control signal provided by a user.

* * * * *